US006463996B1

(12) United States Patent
Streubel et al.

(10) Patent No.: US 6,463,996 B1
(45) Date of Patent: Oct. 15, 2002

(54) DEVICE FOR RESETTING GUIDE SEGMENTS OF CONTINUOUS CASTING OR CONTINUOUS CASTING AND ROLLING PLANT

(75) Inventors: Hans Streubel, Erkrath (DE); Terry Piskorski, Dyersburg, TN (US)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/595,127

(22) Filed: Jun. 16, 2000

(30) Foreign Application Priority Data

Jun. 19, 1999 (DE) ..... 199 28 196

(51) Int. Cl.[7] ..... B22D 11/12

(52) U.S. Cl. ..... 164/441; 164/442; 164/447; 164/413

(58) Field of Search ..... 164/441, 442, 164/447, 448, 484, 413, 454

(56) References Cited

U.S. PATENT DOCUMENTS 4,208,879 A * 6/1980 Segawa ..... 164/314
6,199,621 B1 * 3/2001 Weyer et al. ..... 164/484

* cited by examiner

*Primary Examiner*—M. Alexandra Elve
*Assistant Examiner*—I.-H. Lin
(74) *Attorney, Agent, or Firm*—Sidley Austin Brown & Wood, LLP

(57) ABSTRACT

A device for resetting opposite guide segments of a continuous casting or continuous casting and rolling plant in three different positions, and including a hydraulic cylinder connectable with one of the opposite guide segments, and a double-acting piston connectable with another of the opposite guide segments and displaceable in the hydraulic cylinder between three positions corresponding to the three different positions of the guide segments, with the three positions of the piston in they hydraulic cylinder being defined by stop surfaces at least one of which is located inside the hydraulic cylinder and at least one of which is located outside of the hydraulic cylinder.

7 Claims, 2 Drawing Sheets

DEVICE FOR RESETTING GUIDE SEGMENTS OF CONTINUOUS CASTING OR CONTINUOUS CASTING AND ROLLING PLANT

BACKGROUND OF THE INVENTION

1. Field of the Invention

The invention relates to a device for resetting opposite guide segments of a continuous casting or continuous casting and rolling plant in three different positions, with the device including a hydraulic cylinder connectable with one of the opposite guide segments, a double-acting piston connectable with another of the opposite guide segments and displaceable in the hydraulic cylinder between three positions corresponding to the three different positions of the guide segments and of which three piston positions one position is defined by a stop surface provided inside of the hydraulic cylinder.

2. Description of the Prior Art

European Patent Publication No. EP 0 545 104 B1 discloses a method of and an apparatus for continuous casting of slabs and ingots in a continuous casting plant with a soft-reduction-line, where the plant includes separate rolls replaceable, separately or as segments, by hydraulic cylinders and having the gap there-between or the distance therebetween steplessly adjustable with spindles. The spindles are displaced by a suitable hydraulic system. However, the spindle displacing or adjusting system is expensive and prone to malfunction.

German Publication DE 195 11 113.2 discloses a billet guide system of a plant for continuous casting of thin slabs wherein the guide rollers are supported in separate frames which are biased against stop surfaces by tie rods. For adjusting the guide system by using mechanically preloaded, with tie rods, frames, with which in a simple manner, the guide rollers, which are supported in the frames, can be properly aligned during the casting process, there is provided, between the stop surfaces for the frames, a hydraulic cylinder operating the tie rods. The misalignment of the guide rolls leads to the deviation of the thickness of the slab. Also, the guide system is adjusted in order to compensate for non-uniform thermal expansion of the rollers and for their wear. The spacing between the frames is adjusted steplessly. However, a small adjustment range significantly limits the use of the method and device disclosed in DE 195 11 113.2.

German Publication No. DE 43 06 853 A1 discloses a guide system for a continuous casting plant for producing slab, in particularly, by the method of continuous casting and rolling. To produce slabs having different thicknesses, paired opposite rolls are supported in frames or stand parts connected by tie rods with a piston-cylinder unit. The power flux of the piston-cylinder unit is adjusted by providing spacers between upper and lower frame parts. In order to be able to reset the guide rollers in three definite positions, in particular during the casting and rolling of thin slabs, and in particular in the solidification region, a hydraulic annular cylinder unit is provided between the cylinder of the piston-cylinder unit and the spacers. The annular cylinder unit surrounds the piston rod, with the annular or ring-shaped piston caps the annular cylinder unit carrying the spacers.

DE 43 06 853 A1 contemplates serial connection of the hydraulic cylinders used for operating the billet guiding means which require resetting or adjustment of more than two positions. The drawback of the proposed solution consists in that one or more positions are defined by stops formed in the cylinder. The changes of the reset positions can be effected only with substantial expenses as they require modification of the hydraulic cylinders themselves. The modification of the cylinders is time-consuming and results in putting, e.g., the guide segments of a continuous casting plant out of service for a long time. This requires an availability of a large number of replacement segments. In addition, this arrangement requires the use of two hydraulic cylinders arranged one after another, with two sealing elements for each piston rod. In addition, a tedious adjustment of the spacers is involved.

Accordingly, an object of the present invention is to provide a device which would insure an easy and simple adjustment of the distance between opposite segments of a continuous casting or casting and rolling plant.

SUMMARY OF THE INVENTION

This and other objects of the present invention, which will become apparent hereinafter, are achieved by providing a device in which the three positions are defined by stop surfaces associated with the hydraulic cylinder with at least one stop surface being provided outside of the hydraulic cylinder. By associating the stop surfaces with the hydraulic cylinder, the structure of the device is simplified, and arrangement of at least one stop surface outside of the hydraulic cylinder provides for an easy access thereto and for its easy adjustment.

In accordance with advantageous embodiment of the present invention, the hydraulic cylinder is arranged on an outer side of one of the opposite guide segments, and the piston has a first piston rod provided on one of its sides and connectable to another of the opposite guide segments. The piston rod projects from a cylinder end at which the cylinder is connectable with the one of the opposite guide segments. Such an arrangement insures an easy access to the hydraulic cylinder. In addition, there is space at the free end of the hydraulic cylinder for outer stop surfaces and stops.

Advantageously, the hydraulic cylinder has first and second end walls defining two, first and second, inner stop surfaces, respectively, which define two positions of the piston, with the first end wall having a flange or a pivot lug for connecting the hydraulic cylinder with the one of the opposite guide segments.

Providing a multi-functional end surface, which closes the cylinder chamber, serves as a guide for the first piston rod, and defines an inner stop surface for the piston, reduces the manufacturing costs.

Securing of the hydraulic cylinder at its side through which the first piston rod projects, provides for attachment of a second piston rod to another side of the piston, with the second piston rod extending through a guide bore formed in the second end wall and carrying at its free end a first outer stop. This insures an easy access to the first outer stop.

According to a further advantageous embodiment of the present invention, the hydraulic cylinder has a cylindrical extension, and an annular piston, which defines a first outer stop surface for the first outer stop, is displaceably arranged in the hydraulic extension. The annular piston is displaceable along the second piston rod. The displaceability of the annular piston makes it suitable for defining a middle position of the piston because it is subjected to overpressure when the pressure is insufficient for the main piston to reach its inner position.

The operational position of the annular piston is defined by a collar provided on an inner circumference of the cylindrical extension and which cooperates with a shoulder provided an outer circumference of the annular piston for limiting an outward stroke of the annular piston.

The three positions of the piston are determined by application of pressure to opposite sides of the and one side of the annular piston.

In accordance with a further advantageous embodiment of the invention, the second inner stop surface is replaced by a second outer stop surface for a second outer stop formed by a free end surface of the second piston rod. The second outer stop surface is defined by a pot-shaped member releasably connected with the cylindrical extension. This insures an easy access to two stops and two stop surfaces and an easy adjustment of the positions of at least first stop and a second stop surface.

The adjustment of the positions of the first stop and the second stop surface by using spacers of different thicknesses permits to achieve precise positioning of the first stop and the second stop surface can be achieved.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1A:
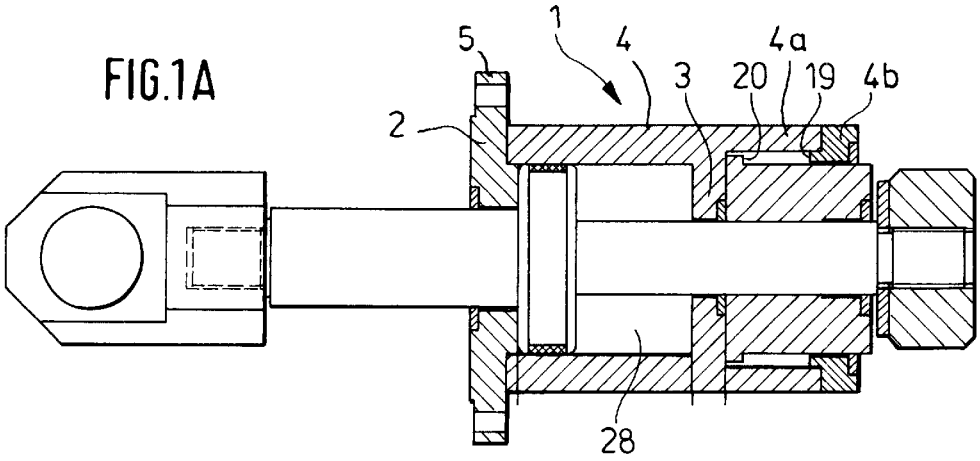
FIG. 1*a* a cross-sectional view of a hydraulic cylinder with a piston in the inner position (with the piston abutting a first inner stop surface)
Figure 1B:
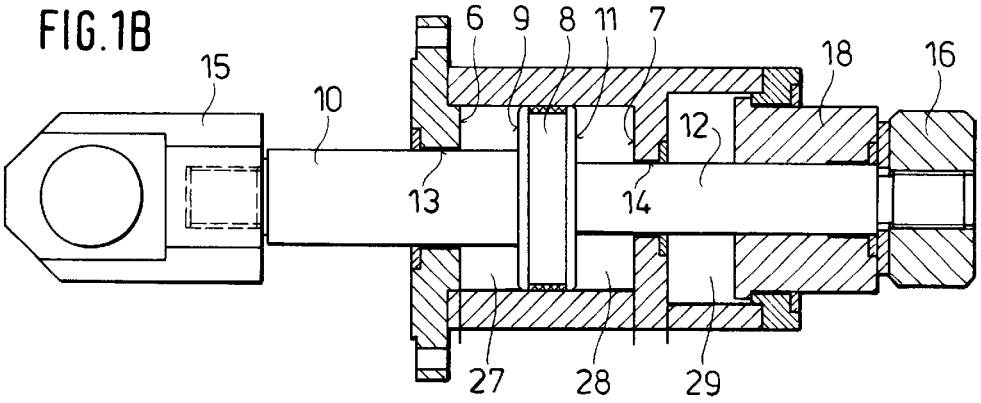
FIG. 1*b* a view similar to that of FIG. 1*a* but with the piston in the middle position (with the piston abutting a first outer stop surface)
Figure 1C:
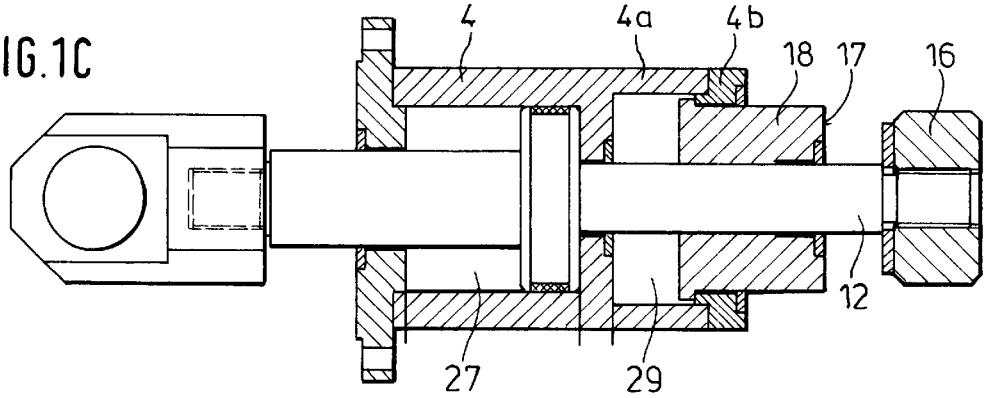
FIG. 1*c* a view similar to that of FIGS. 1*a*–1*b* but with the piston in an outer position (with the piston abutting a second inner stop surface)

FIGS. 1*a*, 1*b*, and 1*c* show a hydraulic cylinder with a first end wall 2 and a second end wall 3 and cylindrical tubular member 4. A cylindrical extension 4*a* adjoins the tubular member 4. The first end wall 2 carries a flange 5 which serves for attaching the hydraulic cylinder 1 to an outer side of a first guide segment of a continuous casting plant or a continuous casting and rolling plant. A first end wall has, inside the hydraulic cylinder 1, a first inner stop surface 6. A second end wall 2 has, inside the hydraulic cylinder 1, a second inner stop surface 7. The first and second inner stop surfaces 6 and 7 limit the displacement of a double acting piston 8 which is displaced in the hydraulic cylinder 1 under sealed conditions.

First and second piston rods 10 and 12 are fixedly secured to the opposite sides 9 and 11 of the piston 8, respectively. The first and second piston rods 10, 12 are sealingly displaceable through first and second guide bores 13 and 14 formed, respectively, in the first and second end walls 2 and 3.

The first piston rod 10 carries, at its free end, an articulated head 15 pivotally connected with the second guide segment of the continuous casting plant or the continuous casting and rolling plant. The second piston rod 12 carries, at its free end, a first outer stop 16 that provides for securing the piston 8 in its middle position. The first outer stop surface 17, which cooperates with the first outer stop 16, forms part of an annular piston 18 displaceable in a cylinder cover 4*b* along the second piston rod 12 under sealing conditions. Its inward stroke is limited by the second end wall 3. Its outer stroke and, thus, the position of the first stop surface 17 is determined by a collar 19 provided on the inner circumference of the cylinder cover 4*b* and a shoulder 20 formed on the outer circumference of the annular piston 18.

Figure 2:
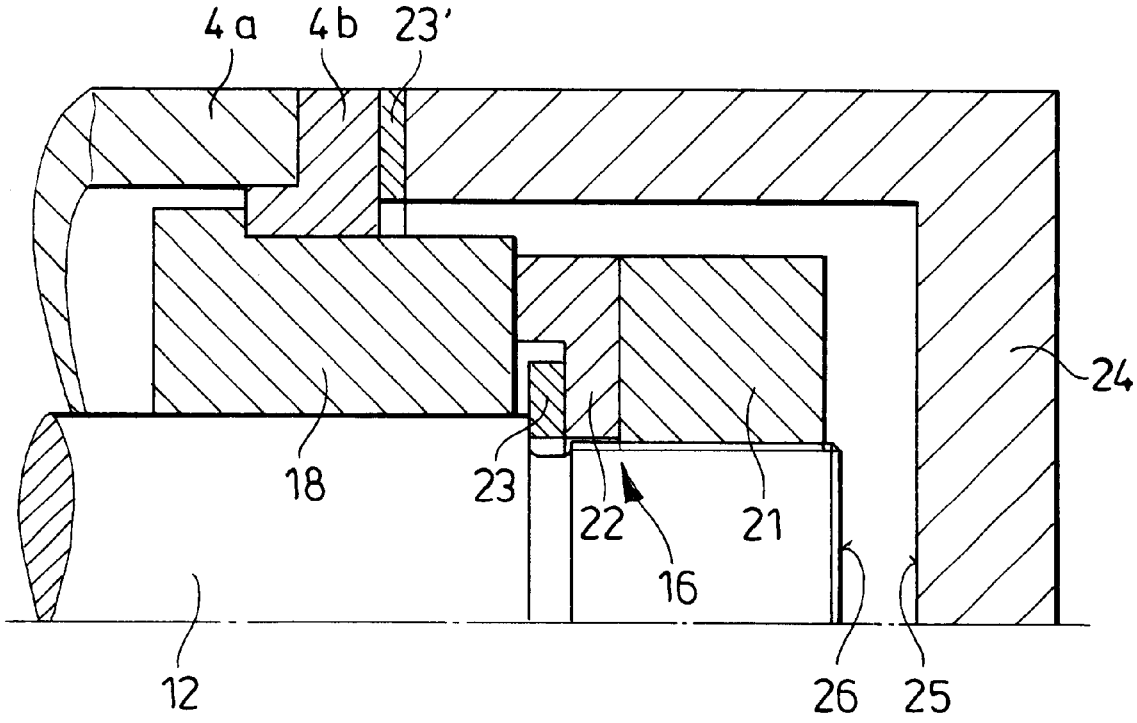
FIG. 2 a cross-sectional view showing a detail of a free end of the hydraulic cylinder (the piston is in the middle position) with an adjustable first outer stop and an adjustable second outer stop surface.

FIG. 2 shows an embodiment in which the first outer stop 16 is adjustable. The adjustment means includes an adjusting nut 21, a stop ring 22, and a support washer 23 which are screwed together on the second piston 12. The adjustment of the stop 16 is effected by using support washers 23 having different thicknesses. A pot-shaped member 24, which is secured to the cylindrical extension 4*a* and the cover 4*b* with the use of another support washer $\mathbf{23}^1$ defines a second outer stop surface 25 for a second outer stop 26 that is formed by a free end surface of the second piston rod 12. The position of the second outer stop surface 25 is adjustable by using support washers $\mathbf{23}^1$ having different thicknesses.

The device according to the present invention functions as follows:

FIG. 1 shows a position of the piston 8 in which it abuts the first inner stop surface 6 and which corresponds to the largest spacing of the guide segments or rolls. The piston 8 is brought into this position by delivering pressure medium, oil, into the second pressure chamber 28 only.

FIG. 1*b* shows a position of the piston 8 in which the first outer stop 16 abuts a first outer stop surface 17. This position of the piston 8 is achieved by delivering the pressure medium, oil, into a third pressure chamber 29. The oil pressure in the pressure chamber 29 keeps the annular piston 18 in its operational position. This provides for the adjustment of the roll gap (billet thickness) which lies between minimal and maximal roll gap dimensions.

FIG. 1*c* shows the position of the piston 8 in which it abuts the second inner stop surface 7 and which corresponds to the minimal spacing between the guide segments or the rolls. This position of the piston 8 is achieved by delivering pressure oil into a first pressure chamber 27.

The adjustment of the three positions of the guide segment is effected only hydraulically. The adjustment of the positions of the first outer stop (16) and of the second outer stop surface 25 (FIG. 2) can be effected without the use of the hydraulic system.

Accordingly, through the present invention was shown and described with reference to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A device for resetting opposite guide segments of a continuous casting or continuous casting and rolling plant in three different positions, the device comprising a hydraulic cylinder including means for connecting the hydraulic cylinder with one of the opposite guide segments; a double-acting piston displaceable in the hydraulic cylinder between three positions corresponding to the three different positions of the guide segments, and having a first piston rod provided on one side thereof and connectable to another of the opposite guide segments and projecting through a first end wall of the hydraulic cylinder; and means defining the three positions of the piston in the hydraulic cylinder and including a first inner stop surface formed by an inner surface of the first end wall of the hydraulic cylinder and defining a first position of the piston; a second inner stop surface formed by an inner surface of a second end wall of the hydraulic cylinder and defining a second position of the piston, and outer stop means located outside of the hydraulic cylinder and defining a third position of the piston intermediate between the first and second positions thereof wherein the outer stop means comprises a first outer stop arranged at a free end of a second piston rod provided on another side of the piston and projecting through the second end wall, and an annular piston displaceable in a cylindrical extension of the hydraulic cylinder along the second piston rod and having a first outer stop surface cooperating with the first outer stop to define the third position of the piston.

2. A device as set forth in claim 1, wherein the cylindrical extension has a collar provided on an inner circumference thereof and cooperating with a shoulder provided an outer circumference of the annular piston for limiting an outward stroke of the annular piston.

3. A device as set forth in claim 2, wherein the cylinder has two pressure chambers for applying pressure to opposite sides of the double-acting piston, and the cylindrical extension has one pressure chamber for applying pressure to a side of the annular piston for displacing same in an outward direction.

4. A device as set forth in claim 1, wherein the outer stop means includes a second outer stop defined by a free end surface of the second piston rod, and a pot-shaped member releasably connected with the free end of the cylindrical extension and defining a second outer stop surface cooperating with the second outer stop.

5. A device as set forth in claim 4, further including means for adjusting positions of the first outer stop and of the second outer stop surface.

6. A device as set forth in claim 5, wherein adjusting means comprises support washers having different thicknesses used for securing the first outer stop on the free end of the second piston rod.

7. A device as set forth in claim 1, wherein the means for connecting the hydraulic cylinder with the one of the guide segments comprises one of a flange and a pivot lug provided on the first end wall.

* * * * *